US006866407B2

(12) United States Patent
Park

(10) Patent No.: US 6,866,407 B2
(45) Date of Patent: Mar. 15, 2005

(54) VEHICLE HEADLIGHT

(75) Inventor: Tae Kyu Park, Seoul (KR)

(73) Assignees: CPIKOREA Ltd., Kyunggi-do (KR); Tae.Kyu Park, Seoul (KR)

( * ) Notice: Subject to any disclaimer, the term of this patent is extended or adjusted under 35 U.S.C. 154(b) by 0 days.

(21) Appl. No.: 10/410,946

(22) Filed: Apr. 10, 2003

(65) Prior Publication Data

US 2004/0114387 A1 Jun. 17, 2004

(30) Foreign Application Priority Data

Dec. 17, 2002 (KR) ..... 10-2002-0080786
Dec. 17, 2002 (KR) ..... 10-2002-0080781

(51) Int. Cl.[7] ..... F21V 11/00

(52) U.S. Cl. ..... 362/508; 362/526; 362/548; 362/286; 362/288

(58) Field of Search ..... 362/508, 526, 362/548, 286, 288, 523, 285, 287, 372, 418, 449, 539, 512, 513

(56) References Cited

U.S. PATENT DOCUMENTS 5,029,050 A * 7/1991 Bergkvist ..... 362/512
6,325,528 B1 * 12/2001 Wittmeier et al. ..... 362/514
6,478,459 B1 * 11/2002 Ui ..... 362/512

* cited by examiner

*Primary Examiner*—Thomas M. Sember
*Assistant Examiner*—Bao Q. Truong
(74) *Attorney, Agent, or Firm*—Marshall, Gerstein & Borun LLP

(57) ABSTRACT

Vehicle headlight including a light emitting unit for emitting a light, an operating member joined with the light emitting unit, the operating member fitted with a magnet, a coil in the vicinity of the operating member for generating a magnetic field, and a housing for holding the operating member and the coil therein, thereby permitting selective lighting of a high beam for regular running at night or a low beam required in crossing an opposite vehicle by using a single light emitting unit and a simple structure.

7 Claims, 8 Drawing Sheets

VEHICLE HEADLIGHT

BACKGROUND OF THE INVENTION

1. Field of the Invention

The present invention relates generally to vehicle headlights, and more particularly, to a vehicle headlight, in which a simple light emitting unit is employed for selective lighting of a high-beam at night or a low-beam during crossing with an oncoming vehicle.

2. Background of the Related Art

In general, the headlights, mounted on the front of a vehicle to ensure an adequate field of view of a driver when driving the-vehicle at night, are required to have a luminance specified by law, and not to obstruct the vision of oncoming drivers.

That is, the headlight is required to form a running beam (so called an upper direction beam, or a high beam) for securing a long range of view during regular running, and a crossing beam (so called a low direction beam, or a low beam) when crossing with an oncoming vehicle so as to prevent the light beams from obstructing the vision of oncoming drivers while securing a certain extent of range of view.

A halogen lamp is widely used in a conventional headlight. The halogen lamp is provided with two filaments, that is, a filament for irradiating a high-beam and a filament for irradiating a low-beam, so a high-beam mode or a low-beam mode may be selectively operated as desired. In this case, the filament for irradiating a low-beam is installed inside the vessel-shaped lamp.

However, when the halogen lamp, which is provided with two filaments, is compared with a gas-discharge lamp which is widely used now, the halogen lamp is inferior in performance to the gas-discharge lamp. Thus, there is a growing tendency to use the gas-discharge lamp for a headlight, because the gas-discharge lamp radiates white light, which is about three times as bright as the conventional halogen lamp, thus making it easy to distinguish objects, and uses two-thirds of the halogen lamp's electric consumption, and is semi-permanent. However, since only one gas-discharge lamp is installed in such a headlight, there is restriction, imposed on the design of the headlight.

That is, it is impossible to develop a gas-discharge lamp having two filaments, that is, two light emitting units so as to irradiate both a high beam and a low beam, so the above-mentioned problem occurs.

In order to overcome such a problem, there has been proposed a method where a light emitting unit is operated by a small-sized motor to instantaneously move upward or downward. However, such a method has a problem that it has a complicated mechanical mechanism because the rotating movement of the motor must be converted into a rectilinear movement, the manufacturing cost is increased, and the operation is slow. For these reasons, the gas-discharge lamp is not widely used in the headlight.

SUMMARY OF THE INVENTION

Accordingly, the present invention has been made keeping in mind the above problems occurring in the prior art, and an object of the present invention is to provide a vehicle headlight which has a simple construction and selectively irradiates a high-beam when driving a vehicle at night or a low-beam so as to prevent light beams from obstructing the vision of oncoming drivers, using a single light emitting unit.

In order to accomplish the above object, the present invention provides a vehicle headlight which is designed such that a single light emitting unit is operated by the operation of an ON/OFF switch to irradiate a low-beam when driving the vehicle at night, and the light emitting unit is rapidly moved toward a coil, according to Fleming's left-hand law, by the magnetic field of the coil and a magnet by operating a dimmer switch when necessary so that a focus of the light emitting unit precisely corresponds with a focus of a parabolic reflecting mirror, thus allowing the operating mode of the headlight to be easily changed into a high-beam mode, therefore allowing the headlight to selectively irradiate the low-beam or the high-beam.

In another aspect of the present invention, there is provided a vehicle headlight including a light emitting unit for emitting a light, an operating member joined with the light emitting unit, the operating member fitted with a magnet, a coil in the vicinity of the operating member for generating a magnetic field, and a housing for holding the operating member and the coil therein.

The operating member is movable in a horizontal direction. The coil is preferably fitted adjacent to the magnet in a horizontal direction, and elastic means is fitted between the magnet and the coil, and more preferably the elastic means is a compression spring.

Preferably, the vehicle headlight further includes a guide member for guiding a horizontal movement of the light emitting unit, and the guide member is cylindrical. Preferably, the guide member serves as a shield.

Preferably, the operating member is movable in a vertical direction. The coil is fitted in the vicinity of the magnet in a vertical direction, and preferably elastic means is fitted between the magnet and the coil.

The housing includes a control rib at an inside wall and a mounting boss on an upper part, the mounting boss fitted with the coil, and the operating member includes a support part having hinge shafts rotatably fitted to the housing, and a support bar having one side connected to the support part and the other side having the magnet fitted thereon. The moving distance of the operating member is preferably in a range of 5~7 mm.

A position of the operating member may be shifted selectively by changing a direction of a current to the coil.

In further aspect of the present invention, there is provided a vehicle headlight including a light emitting unit for emitting a light, an operating member joined with the light emitting unit, the operating member fitted with a magnet, a magnet in the vicinity of the operating member, and a housing for holding the operating member and the coil therein.

BRIEF DESCRIPTION OF THE DRAWINGS

The above and other objects, features and other advantages of the present invention will be more clearly understood from the following detailed description taken in conjunction with the accompanying drawings, in which:

FIGS. 3A and 3B are sectional views of the headlight in FIG. 1, wherein, FIG. 3A shows the headlight in a low-beam state, and FIG. 3B shows the headlight in a high-beam state;

FIGS. 4A and 4B are sectional views each showing a state a headlight mounted to a vehicle in accordance with a preferred embodiment of the present invention, wherein FIG. 4A shows the headlight in a low beam state, and FIG. 4B shows the headlight in a high beam state;

FIGS. 7A and 7B are sectional views of the headlight in FIG. 5, wherein, FIG. 7A shows the headlight in a low-beam state, and FIG. 7B shows the headlight in a high-beam state;

FIGS. 8A and 8B are sectional views each showing a state a headlight mounted to a vehicle in accordance with a preferred embodiment of the present invention, wherein FIG. 8A shows the headlight in a low beam state, and FIG. 8B shows the headlight in a high beam state.

DESCRIPTION OF THE PREFERRED EMBODIMENTS

Reference will now be made in detail to the preferred embodiments of the present invention, examples of which are illustrated in the accompanying drawings.

Figure 1:
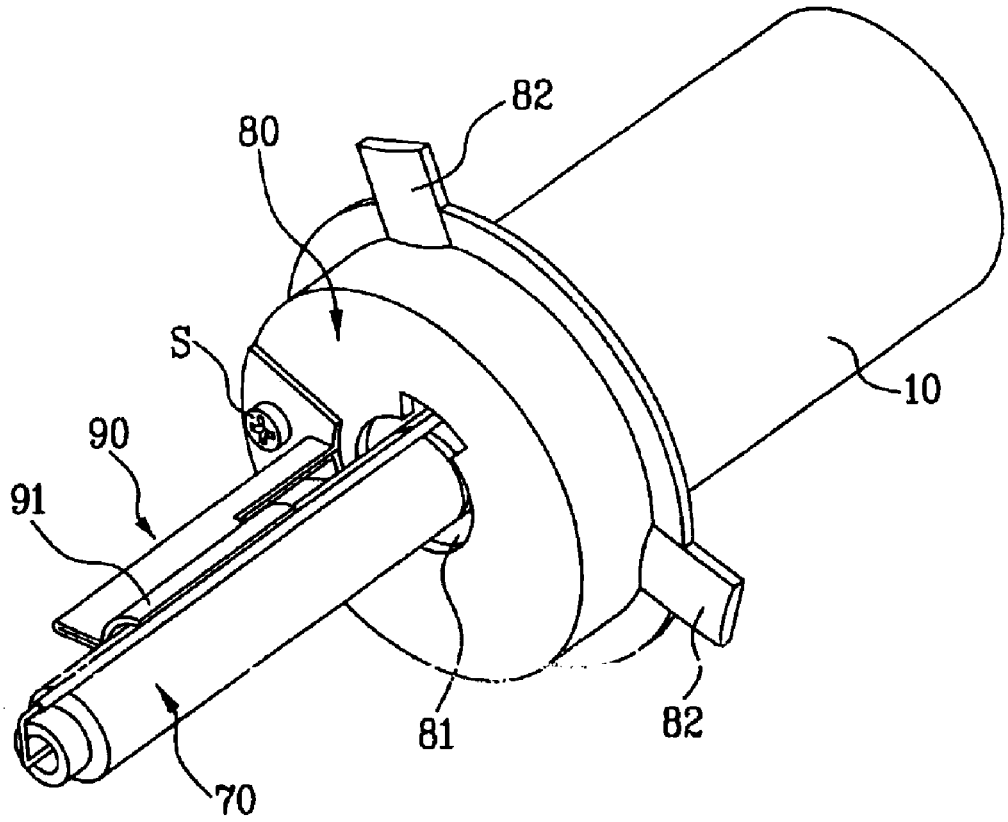
FIG. 1 is a perspective view showing a headlight in accordance with a preferred embodiment of the present invention.
Figure 2:
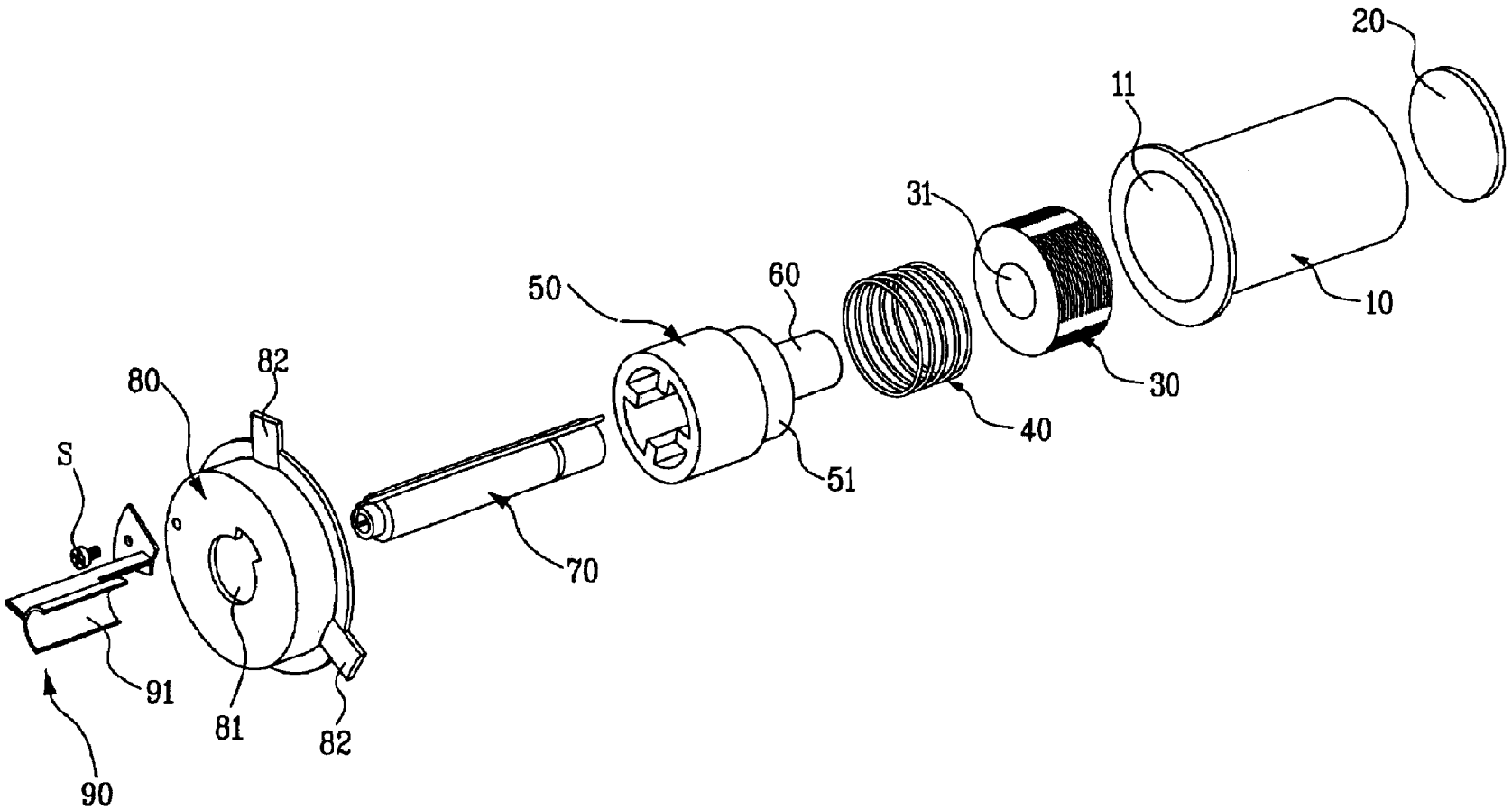
FIG. 2 is an exploded perspective view of the headlight in FIG. 1.

An embodiment of the vehicle headlight of the present invention will be described with reference to FIGS. 1~3.

As shown in the drawings, a headlight according to the present invention includes a cylindrical housing 10 which has a space 11 for receiving several components therein. A coil 30 is fixedly provided in the space 11 at a position adjacent to a rear end of the housing 10. A cover 20 closes the rear end of the housing 10.

A support cap 80 is mounted to a front end of the housing 10 so as to support the housing 10 and ensure that the housing 10 is stably mounted to a parabolic reflecting mirror. A hole 81 is formed at a center of an end wall of the support cap 80 in such a way that a light emitting unit 70 is axially projected through the hole 81. Three radial locking pieces 82 are provided at three predetermined positions along a side-wall of the support cap 80. Thus, the light emitting unit 70 moves in and out the housing 10 through the hole 81 of the support cap 80.

It is preferable that a guide unit 90 is mounted to the support cap 80 to smoothly guide the movement of the light emitting unit 70. The guide unit 90 is mounted to the end wall of the support cap 80 using a setscrew S. The guide unit 90 is provided with a semi-cylindrical guide 91. The guide 91 surrounds a part of an outer circumferential portion of the light emitting unit 70 in such a way as that the light emitting unit 70 is slidably moved in and out the hole 81 of the support cap 80. The guide member 90 can also serve as a shield for forming a cut off line in lighting the low beam. Of course, the shield may be fitted separately.

Further, according to the present invention, a operating member 50 is provided in the space 11 of the housing 10 at a position adjacent to the front end of the housing 10, and axially holds an inside portion of the light emitting unit 70. A holding step 51 is formed at an inside end of the operating member 50 to hold an end of the compression spring 40. A magnet 60 is mounted to an inside end of the holding step 51 so as to move the operating member 50 with the light emitting unit 70 rearward due to a magnetic field.

That is, the coil 30 and the magnet 60, which are provided in the space 11 of the housing 10 in such a way as to be adjacent to the rear end of the housing 10, cooperate with each other to pull the operating member 50 along with the light emitting unit 70, thus changing the position of the light emitting unit 70, that is, a light emitting focus of the light emitting unit 70. In other words, the light emitting unit 70 is instantaneously moved rearward, according to Fleming's left-hand law, by the magnetic field of the coil 30 and the magnet 60, when a dimmer switch is operated. At this time, the focus of the light emitting unit 70 precisely corresponds with the focus of the reflecting mirror.

When the dimmer switch is operated again to change from a high-beam mode to a low-beam mode, an electric current supplied to the coil 30 is immediately shut off. At this time, the compression spring 40 interposed between the holding step 51 of the operating member 50 and the coil 30 is returned to its original position by a restoring force of the compression spring 40.

The operation of the headlight according to the present invention will be described in detail, with reference to FIGS. 3 and 4.

Figure 3A:
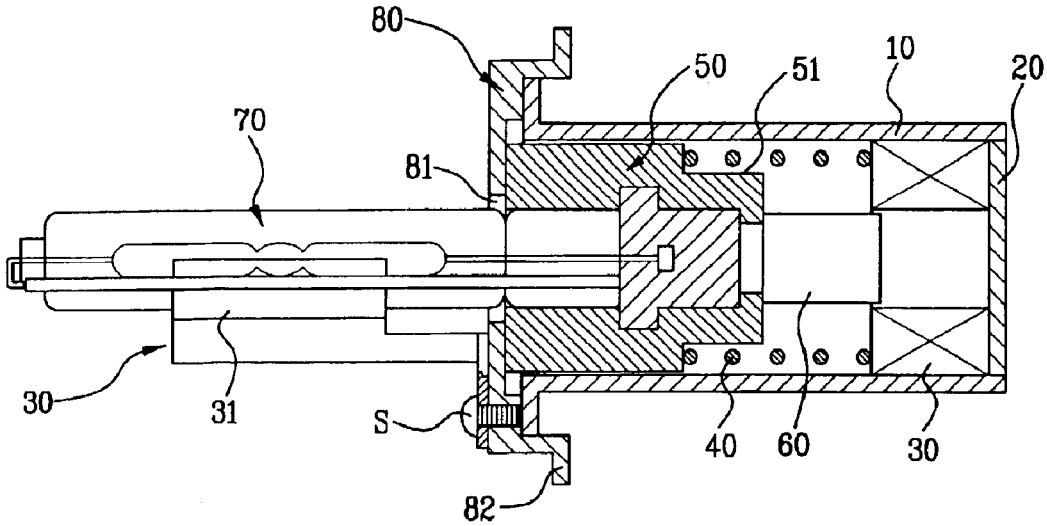
Figure 3B:
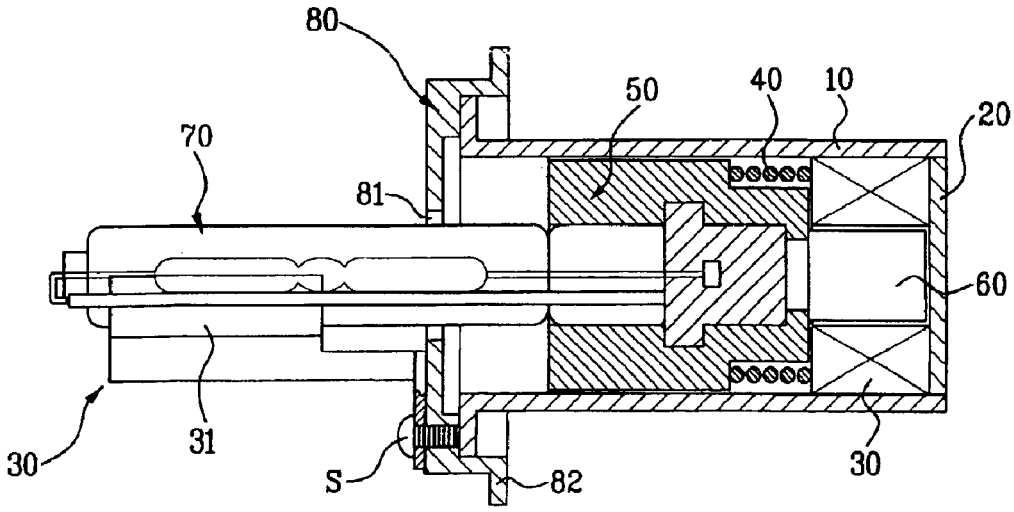
Figure 4A:
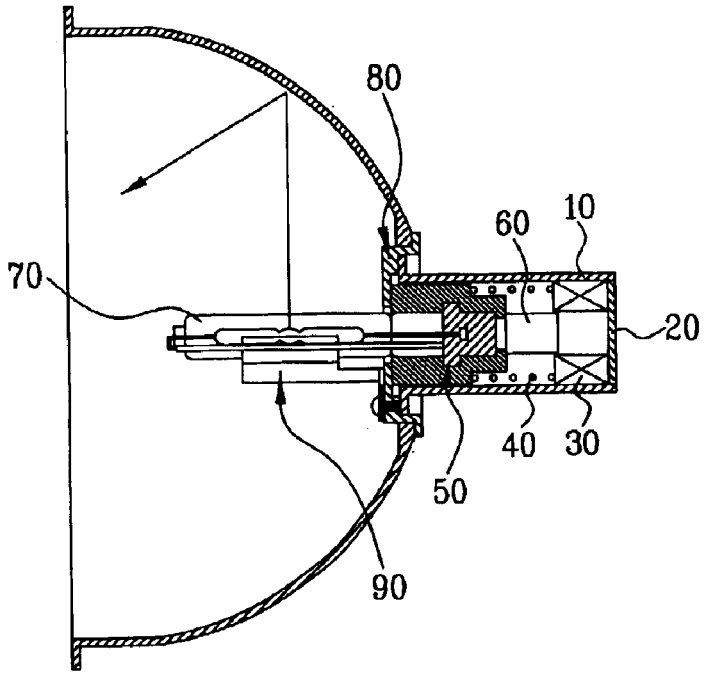
Figure 4B:
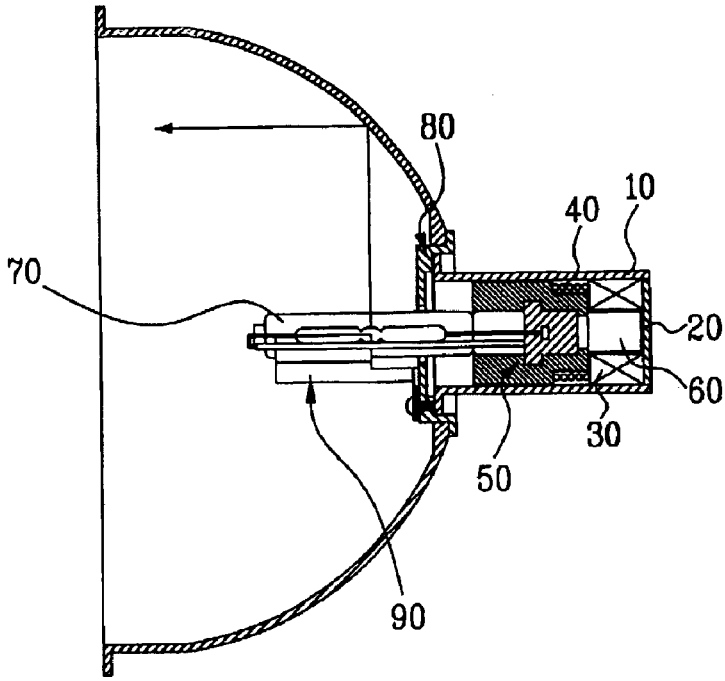
Figure 5:
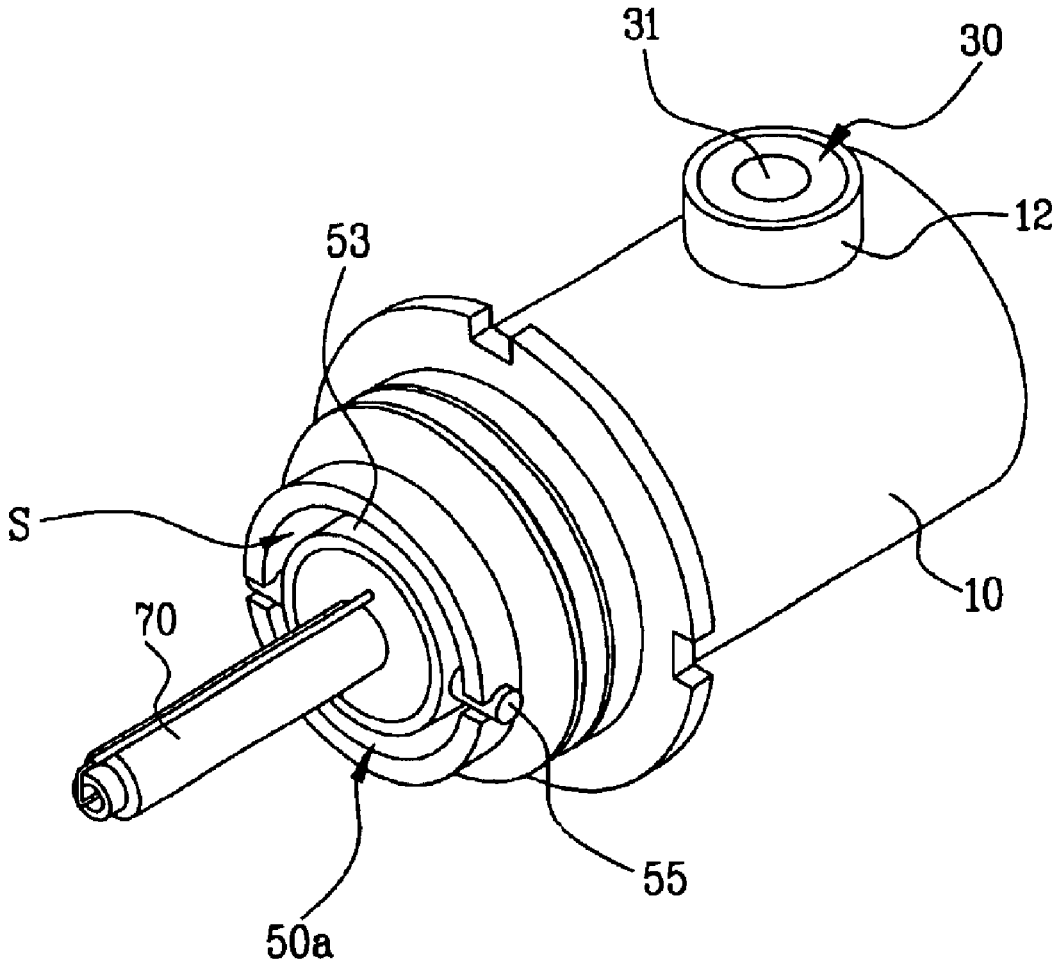
FIG. 5 is a perspective view showing a headlight in accordance with another preferred embodiment of the present invention.
Figure 6:
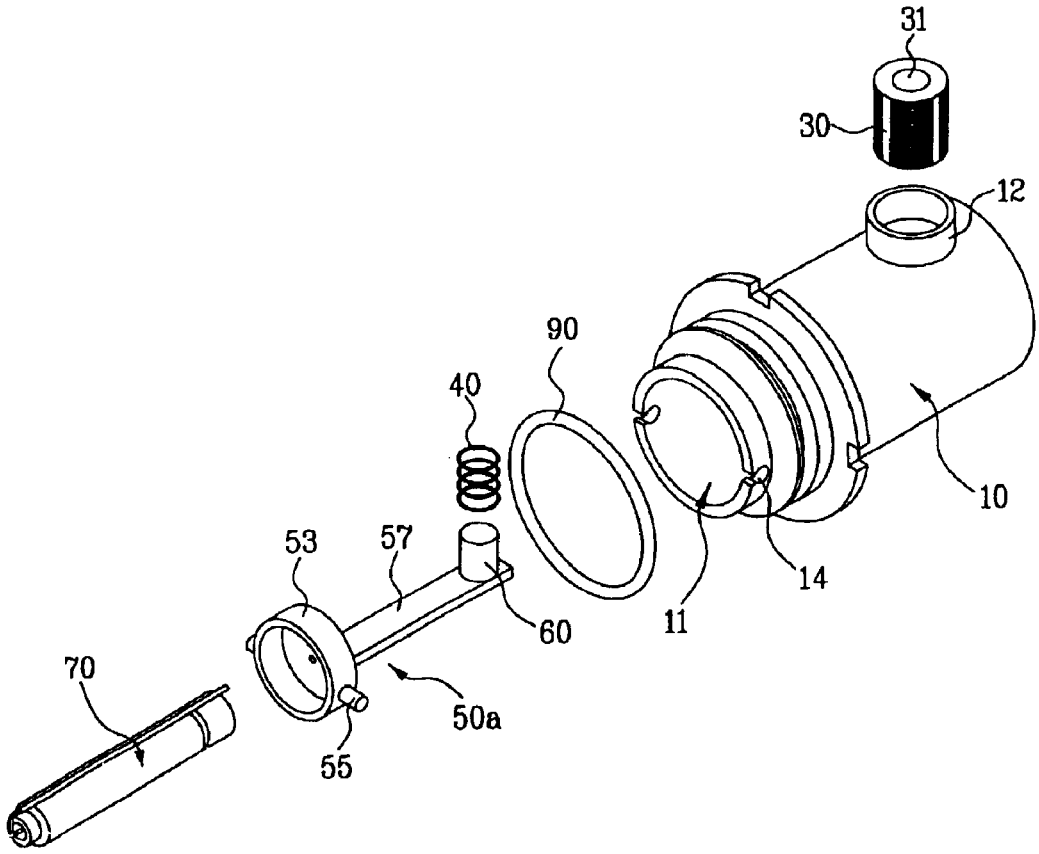
FIG. 6 is an exploded perspective view of the headlight in FIG. 5.

Referring to FIGS. 3A and 4A, the compression spring 40 is interposed between the operating member 50, which is provided in the space 11 of the housing 10 and axially holds the inside portion of the light emitting unit 70, and the coil 30, which is provided in the space 11 of the housing 10 at a position adjacent to the rear end of the housing 10. When one desires to irradiate a high-beam in such a state, the dimmer switch is turned on. At this time, an electric current is applied to the coil 30, so a magnetic field is produced in the coil 30. Due to the magnetic field, the magnet 60 mounted to the operating member 50 moves into an axial guide hole 31 of the coil 30. Simultaneously, the light emitting unit 70 is moved into the space 11 of the housing 10 along with the operating member 50, so the focus of the light emitting unit 70 is formed as shown in FIGS. 3B and 4B. That is, the focus of the light emitting unit 70 coincides with the focus of the reflecting mirror.

Such an operational principle follows Fleming's left-hand law, which defines the relationship between the magnitude and direction of a force, the direction of an electric current and a magnetic field. That is, when an electric current is applied to the coil 30 which is placed between two electrodes of a permanent magnet, a force for moving the coil 30 in a given direction is generated. According to such a principle, the operating member 50 holding the light emitting unit 70 moves toward the coil 30 via a magnetic force of the magnet 60.

Meanwhile, when the dimmer switch is operated again to irradiate a low-beam, the electric current supplied to the coil 30 is shut off, and the operating member 50 holding the light emitting unit 70 is returned to its original position by the restoring force of the compression spring 40. In the headlight of the present invention, a force is generated between the coil 30 and the magnet 60 according to Fleming's left hand law when the dimmer switch is operated to irradiate a high-beam. Thus, the operating member 50 holding the light emitting unit 70 is moved toward the coil 30, which is fixedly provided in the housing 10 at a position adjacent to the rear end of the housing 10, by a magnetic force of the magnet 60 which is fixed to the operating member 50. The headlight of the present invention allows the focus of the light emitting unit 70 held by the operating member 50 to be easily changed, thus being very simple to selectively irradiate a high-beam or a low-beam. Although the headlight of the present invention is operated by electrically moving a single light emitting unit 70, the same operational effect as a conventional headlight with two light emitting units is achieved. Further, the headlight of the present invention allows the merits of the gas-discharge lamp to be maximally utilized.

In the meantime, it is preferable that a horizontal distance of movement of the operating member 50 is approx. 5~7 mm. Because, according to FMVSS 108, an US automobile standard, a distance between two filaments is 6.3 mm when two filaments are provided in a front/rear direction. Of course, the horizontal distance of movement of the operating member 50 is not limited to 5~7 mm, but an appropriate adjustment is possible for taking accuracies of different components into account or obtaining an optimal performance.

Another embodiment of the present invention will be described with reference to FIGS. 5~8.

The embodiment is operative in a principle the same with the foregoing embodiment, except the operating member is operative in a vertical direction while the operating member of the foregoing embodiment is operative in the horizontal direction.

A control rib 13 is provided on an inside wall of the housing 10 to limit a vertical moving range of an operating member 50*a*.

Two hinge slots 14 are axially formed at opposite positions of an edge of a mouth of the housing 10 such that two latitudinal hinge shafts 55, which are provided on a sidewall of the support part 53, are seated into the hinge slots 14. A mounting boss 12 is provided at a position of an upper portion of the housing 10. The coil 30 is inserted into the mounting boss 12 such that the magnet 60 is moved into an axial guide hole 31 which is formed through a center of the coil 30.

In the meantime, the operating member 50*a* of the embodiment includes a support part 53 fitted to one side of the light emitting unit 70, and a support bar 57 fitted to the other side of the support part 53. The support part 53 has hinge shafts 55 for inserting into hinge slots 14 in the housing 10, and a magnet 60 is fitted on an upper surface of a fore end of the support bar 57.

When an electric current is applied to the coil 30 which is inserted into the mounting boss 12, the magnet 60 is inserted into the axial guide hole 31 of the coil 30. The magnet 60 is moved along with the operating member 50*a*. The operating member 50*a* includes the support part 53 and the support bar 57. A light emitting unit 70 is mounted to a center of the support part 53. The latitudinal hinge shafts 55 are provided on the sidewall of the support part 53, and seated into the hinge slots 14 of the housing 10. The support bar 51 is eccentrically mounted at an end thereof to a rear portion of the support part 53.

An annular gap S is defined between the inner circumferential surface of the housing 10 provided with the hinge slot 14 and the outer circumferential surface of the support part 53 of the operating member 50, so that the gap changes a focus of the light emitting unit 70, thus selectively irradiating a low beam or a high beam. Preferably, a width of the gap S is set to 1–3 mm. Because, according to FMVSS 108, an US automobile standard, a distance between two filaments is 2.3 mm when two filaments are provided in an up/down direction. Such a gap S allows the operating member 50*a* to pivot on the hinge shafts 55 in a seesaw manner. When it is required to change from a low-beam mode to a high-beam mode, a bulb, which is provided along a center of the light emitting unit 70, is moved by about 2.3 mm during the seesaw action of the operating member 50*a*. Of course, the vertical distance of movement of the operating member 50*a* is not limited to 1~3 mm, but an appropriate adjustment is possible for taking accuracies of different components into account or obtaining an optimal performance.

According to the present invention, a position of the light emitting unit 70, that is, a focus of the light emitting unit 70 is changed by attraction between the coil 30 inserted into the mounting boss 12 of the housing 10 and the magnet 60 mounted on the support bar 57 of the operating member 50*a* due to the magnetic field of the coil 30 and the magnet 60. That is, when the dimmer switch is operated to change the position of the light emitting unit 70, the operating member 50*a* holding the light emitting unit 70 is rapidly moved to the coil 30 according to Fleming's left-hand law by the magnetic field of the coil 30 and the magnet 60, so that the focus of the light emitting unit 70 precisely corresponds to a focus of the reflecting mirror.

When the dimmer switch is operated again to change from a high-beam mode to a low-beam mode, the electric current applied to the coil 30 is immediately shut off. At this time, the operating member 50*a* is downwardly moved by a restoring force of the spring 40 which is fitted over the magnet 60 to be elastically interposed between the support bar 57 and the coil 30, thus rapidly returning to an original state. In the embodiment of the present invention, the spring 40 comprises a compression coil spring. Alternatively, the spring 40 may comprise a tension spring to achieve the same operational effect.

The operation of the headlight according to the present invention will be described in detail with reference to FIGS. 7 and 9.

Figure 7A:
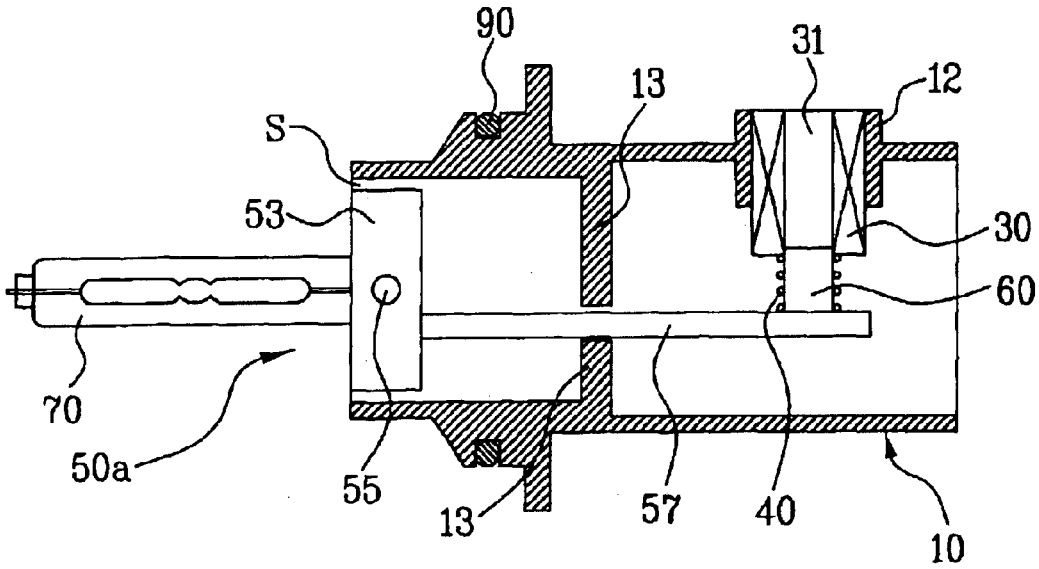
Figure 8A:
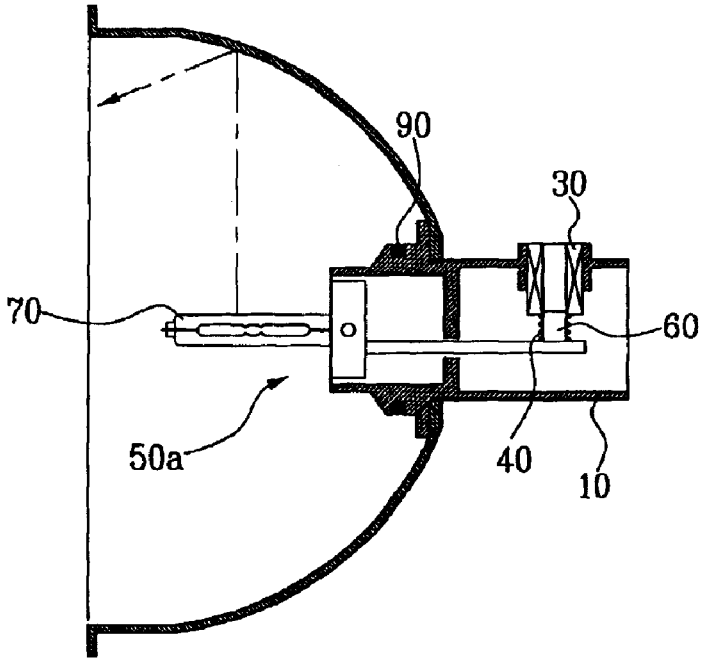

Referring to FIGS. 7A and 8A, a focus of the light emitting unit 70 is changed, when the operating member 50*a* holding the light emitting unit 70 pivots on the hinge shafts 55 in a seesaw manner. In normal times, the spring 40 which is fitted over the magnet 60 to be elastically interposed between the support bar 57 and the coil 30, biases the support bar 57 downward by a spring force, so a low-beam mode is normally operated.

Figure 7B:
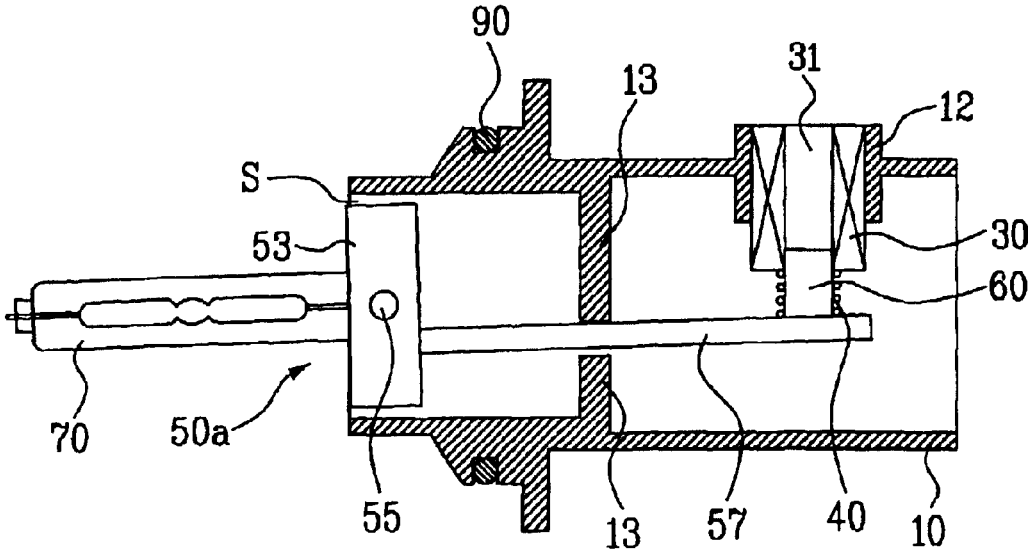
Figure 8B:
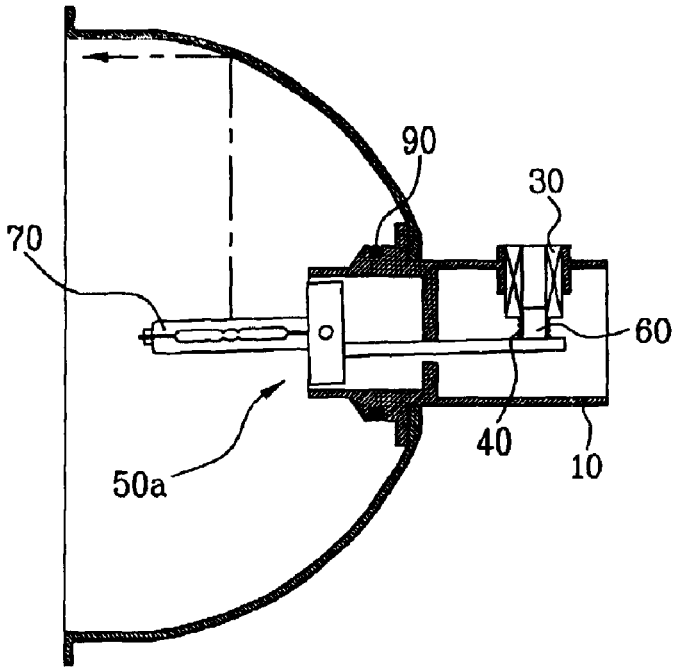

When one desires to operate a high-beam mode in such a state, the dimmer switch is turned on. At this time, an electric current is applied to the coil 30, so a magnetic field is formed in the coil 30. Due to the magnetic field, the magnet 60 mounted on the rear portion of the support bar 57 is inserted into the guide hole 31 of the coil 30 while the support part 53 holding the light emitting unit 70 is downwardly moved, so the focus of the light emitting unit 70 is moved as shown in FIGS. 7*b* and 8B. That is, when a current is applied to the coil 30, the support bar 57 moves up around the hinge shafts on the support part 53, and the light emitting unit 70 moves down.

Such an operating principle follows Fleming's left-hand law, which defines the relationship between the magnitude and direction of a force, the direction of an electric current and a magnetic field. That is, when an electric current is applied to the coil 30 which is placed between two electrodes of a permanent magnet, a force for moving the coil 30 in a given direction is generated. According to such a principle, the operating member 50*a* holding the light emitting unit 70 easily moves toward the coil 30 via a magnetic force of the magnet 60.

Meanwhile, when the dimmer switch is operated again, the electric current applied to the coil 30 is shut off. At this time, the operating member 50*a* holding the light emitting unit 70 is rapidly returned to its original state by a restoring force of the spring 40, so the light emitting unit 70 is changed to a low-beam mode. A force generated between the coil 30 and the magnet 60 follows Fleming's left-hand law.

In the headlight of the present invention, according to Fleming's left-hand law, the magnet 60 of the operating member 50*a* which is received in the housing 10 is moved to the coil 30 which is inserted into the mounting boss 12 by a magnetic force of the magnet 60 of the operating member 50*a* holding the light emitting unit 70. The headlight of the present invention allows the focus of the light emitting unit 70 to be easily changed, thus being very simple to selectively irradiate a high beam or a low-beam. Although the headlight of the present invention is operated by electrically moving a single light emitting unit 70, the same operational effect as a conventional headlight with two light emitting units is achieved. Further, the headlight of the present invention allows the merits of the gas-discharge lamp to be maximally utilized.

In the meantime, though the embodiment describes the hinge shafts 55 at left/right sides of the support part of the operating member 55*a* for the seesaw movement of the operating member 55*a*, the present invention does not limit to this. That is, the hinge shafts 55 may be formed in an up/down direction for moving the operating member 55*a* in up/down direction wholly, to control a position of a focal point of the light emitting unit 70.

As described above, the present invention provides a vehicle headlight which is simply operated according to Fleming's left-hand law and selectively irradiates a high beam so as to provide long-range illumination when driving the vehicle at night or a low beam so as not to obstruct the vision of oncoming drivers, using a single light emitting unit.

Further, the present invention provides a vehicle headlight which is easily replaced with a conventional headlight using a halogen lamp without changing the structure of an existing vehicle, and which allows gas-discharge lamps which are now used only in luxury cars to be widely used.

In the meantime, though the foregoing embodiments show an operating member 50 or 50*a* fitted with a magnet 60, and a housing 10 fitted with a coil 30, the present invention is not limited to this. That is, the coil 30 may be fitted to the operating member 50 or 50*a*, and the magnet 60 may be fitted to the housing 10.

Moreover, elastic means, i.e., a spring is fitted between the magnet 60 and the coil 30, so that the light emitting unit 70 positioned in a low beam state by the elastic force of the spring is shifted to a high beam position as a current is applied to the coil 30, which causes the magnet 60 to overcome the elastic force of the spring to move toward the coil direction 30. However, the present invention is not limited to this, but, without using the spring 40, a direction of the current to the coil 30 may be changed selectively, to achieve the same object.

Furthermore, though the embodiments describe that the light emitting unit is a gas discharge lamp, the present invention is not limited to this, but a halogen lamp may be used. Also, though the reflective mirror is a parabolic mirror, the present invention is not limited to this.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A vehicle headlight comprising:

a housing having a space in an inside thereof, a control rib on an inside wall, hinge slots in an edge of an inlet, and a mounting boss on an outside circumference;

a coil to be inserted and fixed to an inside of the mounting boss, having a guide hole in a central part;

an operating member having a support part with one side a light emitting unit joined thereto and hinge shafts on an outer circumference for inserting in the hinge slots, and a support bar eccentrically joined to the other side of the support part;

a magnet attached to an upper surface of a fore end of the support bar, for moving inside of the guide hole in the coil by a magnetic field; and a compression spring elastically disposed between a bottom of the support bar having the magnet attached thereto and an inside of the housing.

2. The vehicle headlight as claimed in claim 1, wherein a moving gap is secured between an inside diameter of the housing having the hinge slot formed therein and an outside diameter of the support part of the operating member having the hinge shafts formed thereon for varying a position of focal point.

3. The vehicle headlight as claimed in claim 2, wherein the moving gap is in a range of 1mm~3mm.

4. The vehicle headlight as claimed in claim 1, wherein the operating member is movable in a vertical direction.

5. The vehicle headlight as claimed in claim 4, wherein the operating member pivots on the hinge shafts in a seesaw manner.

6. The vehicle headlight as claimed in claim 1, wherein the control rib is provided to limit a vertical moving range of the operating member.

7. A vehicle headlight comprising:

a light emitting unit for emitting light;

an operating member joined with the light emitting unit, the operating member fitted with a magnet;

a coil in the vicinity of the operating member for generating a magnetic field; and a housing for holding the operating member and the coil therein, wherein the operating member is movable in a vertical direction, wherein the coil is fitted in the vicinity of the magnet in a vertical direction, and an elastic means is fitted between the magnet and the coil, and wherein the housing includes a control rib at an inside wall and a mounting boss on an upper part, the mounting boss fitted with the coil, and the operating member includes a support part having hinge shafts rotatably fitted to the housing, and a support bar having one side connected to the support part and the other side having the magnet fitted thereon.

* * * * *